US008015018B2

(12) United States Patent
Seefeldt et al.

(10) Patent No.: US 8,015,018 B2
(45) Date of Patent: Sep. 6, 2011

(54) MULTICHANNEL DECORRELATION IN SPATIAL AUDIO CODING

(75) Inventors: Alan Jeffrey Seefeldt, San Francisco, CA (US); Mark Stuart Vinton, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1125 days.

(21) Appl. No.: 11/661,010

(22) PCT Filed: Aug. 24, 2005

(86) PCT No.: PCT/US2005/030453

§ 371 (c)(1),
(2), (4) Date: Apr. 12, 2007

(87) PCT Pub. No.: WO2006/026452

PCT Pub. Date: Mar. 9, 2006

(65) Prior Publication Data

US 2008/0126104 A1 May 29, 2008

Related U.S. Application Data

(60) Provisional application No. 60/705,784, filed on Aug. 5, 2005, provisional application No. 60/700,137, filed on Jul. 18, 2005, provisional application No. 60/604,725, filed on Aug. 25, 2005.

(51) Int. Cl.
*G10L 19/00* (2006.01)
*H04R 5/00* (2006.01)

(52) U.S. Cl. ..... 704/501; 704/503; 381/23; 381/61

(58) Field of Classification Search ..... 704/500, 704/503; 381/17, 61, 63; 375/229, 232, 375/350; 708/310, 315
See application file for complete search history.

(56) References Cited

U.S. PATENT DOCUMENTS 5,323,396 A 6/1994 Lokhoff
(Continued)

FOREIGN PATENT DOCUMENTS

GB 2353926 A 3/2001
(Continued)

OTHER PUBLICATIONS

Molgedey et al, Separation of a Mixture of Independent Signals Using Time Delayed Correlations, Jun. 1994, Institut für Theoretische Physik, Olshausenstrasse 40, D-24118 Kiel 1, Germany.*

(Continued)

*Primary Examiner* — Vincent P Harper
(74) *Attorney, Agent, or Firm* — Thomas A. Gallagher

(57) ABSTRACT

Each of N audio signals are filtered with a unique decorrelating filter (38) characteristic, the characteristic being a causal linear time-invariant characteristic in the time domain or the equivalent thereof in the frequency domain, and, for each decorrelating filter characteristic, combining (40, 44, 46), in a time and frequency varying manner, its input (Zi) and output (Z-i) signals to provide a set of N processed signals (X i). The set of decorrelation filter characteristics are designed so that all of the input and output signals are approximately mutually decorrelated. The set of N audio signals may be synthesized from M audio signals by upmixing (36), where M is one or more and N is greater than M.

17 Claims, 4 Drawing Sheets

U.S. PATENT DOCUMENTS

| | | | | |
|---|---|---|---|---|
| 5,539,829 | A | 7/1996 | Lokhoff et al. | |
| 5,583,962 | A | 12/1996 | Davis et al. | |
| 5,606,618 | A | 2/1997 | Lokhoff et al. | |
| 5,621,855 | A | 4/1997 | Veldhuis et al. | |
| 5,632,005 | A | 5/1997 | Davis et al. | |
| 5,633,981 | A | 5/1997 | Davis | |
| 5,727,119 | A | 3/1998 | Davidson et al. | |
| 5,812,971 | A | 9/1998 | Herre | |
| 6,021,386 | A | 2/2000 | Davis et al. | |
| 6,931,123 | B1 * | 8/2005 | Hughes | 379/406.01 |
| 7,583,805 | B2 * | 9/2009 | Baumgarte et al. | 381/61 |
| 7,668,722 | B2 * | 2/2010 | Villemoes et al. | 704/500 |
| 7,720,230 | B2 * | 5/2010 | Allamanche et al. | 381/22 |
| 2001/0044713 | A1 | 11/2001 | Lokhoff et al. | |
| 2003/0026441 | A1 | 2/2003 | Faller | |
| 2003/0035553 | A1 * | 2/2003 | Baumgarte et al. | 381/94.2 |
| 2003/0036441 | A1 | 2/2003 | Faller | |
| 2003/0187663 | A1 | 10/2003 | Truman et al. | |
| 2003/0219130 | A1 * | 11/2003 | Baumgarte et al. | 381/17 |
| 2003/0236583 | A1 | 12/2003 | Baumgarte et al. | |
| 2005/0180579 | A1 * | 8/2005 | Baumgarte et al. | 381/63 |
| 2005/0265558 | A1 * | 12/2005 | Neoran | 381/17 |
| 2006/0018486 | A1 * | 1/2006 | Neoran et al. | 381/63 |
| 2007/0055510 | A1 * | 3/2007 | Hilpert et al. | 704/230 |
| 2007/0189426 | A1 * | 8/2007 | Kim et al. | 375/343 |
| 2008/0033732 | A1 * | 2/2008 | Seefeldt et al. | 704/500 |
| 2008/0037796 | A1 * | 2/2008 | Jot et al. | 381/17 |
| 2008/0091436 | A1 * | 4/2008 | Breebaart et al. | 704/500 |
| 2008/0304670 | A1 * | 12/2008 | Breebaart | 381/17 |

FOREIGN PATENT DOCUMENTS

| | | | |
|---|---|---|---|
| JP | 2000-152399 | | 5/2000 |
| JP | 2004-048741 | | 2/2004 |
| WO | 03/007656 | A1 | 1/2003 |
| WO | 03/090206 | A1 | 10/2003 |
| WO | 03/090207 | A1 | 10/2003 |
| WO | 03/090208 | A1 | 10/2003 |
| WO | 2005/086139 | A1 | 9/2005 |
| WO | WO 2006/026452 | A1 | 3/2006 |

OTHER PUBLICATIONS

Schroeder, Synthesis of low-peak-factor signals and binary sequences with low autocorrelation, IEEE Transact. Inf. Theor., 16535-89, 1970.*

Notification of Transmittal of the International Search Report and the Written Opinion of the International Searching Authority, or the Declaration, PCT/US2005/030453, Dec. 30, 2005.

Davis, Mark, "The AC-3 Multichannel Coder", Audio Engineering Society Preprint 3774, 95th AES Convention, Oct. 1993.

Bosi, et al., "High Quality, Low-Rate Audio Transform Coding for Transmission and Multimedia Applications", Audio Engineering Society Preprint 3365, 93rd AES Convention, Oct. 1992.

Bosi, M., et al., "ISO/IEC MPEG-2 Advanced Audio Coding", Proc. of the 101st AES-Convention, 1996.

Brandenberg, K., "MP3 and AAC explained", Proc. of the AES 17th Intl Conference on High Quality Audio Coding, Florence, Italy, 1999.

Soulodre, G.A., et al., "Subjective Evaluation of State-of-the-Art Two-Channel Audio Codecs", J. Audio Eng. Soc., vol. 46, No. 3, pp. 164-177, Mar. 1998.

Vernon, Steve, "Design and Implementation of AC-3 Coders", IEEE Trans. Consumer Electronics, vol. 41, No. 3, Aug. 1995.

ATSC Standard A52/a: Digital Audio Compression Standard (Ac-3), Revision A, Advanced Television Systems Committee, Aug. 20, 2001.

Faller, et al., "Binaural Cue Coding Applied to Stereo and Multi-Channel Audio Compression", Audio Engineering Society Convention Paper 5574, 112th Convention, Munich, May 2002.

Baumgarte, et al., "Why Binaural Cue Coding is Better than Intensity Stereo Coding", Audio Engineering Society Convention Paper 5575, 112th Convention, Munich, May 2002.

Baumgarte, et al., "Design and Evaluation of Binaural Cue Coding Schemes", Audio Engineering Society Convention Paper 5706, 113th Convention, Los Angeles, Oct. 2002.

Faller, et al., "Efficient Representation of Spatial Audio Using Perceptual Parameterization", IEEE Workshop on Applications of Signal Processing to Audio and Acoustics, New York, Oct. 2001, pp. 199-202.

Baumgarte, et al., "Estimation of Auditory Spatial Cues for Binaural Cue Coding", Proc. ICASSP 2002, Orlando, FL, May 2002, pp. II-1801-1804.

Faller, et al., "Binaural Cue Coding: A Novel and Efficient Representation of Spatial Audio", Proc. ICASSP 2002, Orlando, FL, May 2002, pp. II-1841-1844.

Breebaart, et al., "High-quality parametric spatial audio coding at low bitrates", Audio Engineering Society Convention Paper 6072, 116th Convention, Berlin, May 2004.

Baumgarte, et al., "Audio Coder Enhancement using Scalable Binaural Cue Coding with Equalized Mixing", Audio Engineering Society Convention Paper 6060, 116th Convention, Berlin, May 2004.

Schuijers, et al., "Low complexity parametric stereo coding", Audio Engineering Society Convention Paper 6073, 116th Convention, Berlin, May 2004.

Engdegard, et al., "Synthetic Ambience in Parametric Stereo Coding", Audio Engineering Society Convention Paper 6074, 116th Convention, Berlin, May 2004.

Herre, et al., "Intensity Stereo Coding", Audio Engineering Society Preprint 3799, 96th Convention, Amsterdam, 1994.

Bosi, et al., "ISO/IEC MPEG-2 Advanced Audio Coding", Journal of the AES, vol. 45, No. 10 Oct. 1997, pp. 789-814.

ISO/IEC JTC1/SC29, "Information technology—very low bitrate audio-visual coding", ISO/IEC IS-14496, Part 3, 1996 1) ISO/IEC 13818-7, MPEG-2 Advanced Audio Coding, AAC, Intl Standard 1997.

Schuijers, et al., "Advances in Parametric Coding for High-Quality Audio", Audio Engineering Society Convention Paper 5852, 114th Convention, Amsterdam, Netherlands, Mar. 22-25, 2003.

Intl Searching Authority, "Notification of Transmittal of the Intl Search Report and the Written Opinion of the Intl Searching Authority, or the Declaration", mailed Aug. 24, 2005, Intl Application No. PCT/US2005/030453.

* cited by examiner

MULTICHANNEL DECORRELATION IN SPATIAL AUDIO CODING

TECHNICAL FIELD

The present invention relates to audio encoders, decoders, and systems, to corresponding methods, to computer programs for implementing such methods, and to a bitstream produced by such encoders.

BACKGROUND ART

Certain recently-introduced limited bit rate coding techniques analyze an input multi-channel signal to derive a downmix composite signal (a signal containing fewer channels than the input signal) and side-information containing a parametric model of the original sound field. The side-information and composite signal are transmitted to a decoder that applies the parametric model to the composite signal in order to recreate an approximation of the original sound field. The primary goal of such "spatial coding" systems is to recreate a multi-channel sound field with a very limited amount of data; hence this enforces limitations on the parametric model used to simulate the original sound field. Details of such spatial coding systems are contained in various documents, including those cited below under the heading "Incorporation by Reference."

Such spatial coding systems typically employ parameters to model the original sound field such as interchannel amplitude differences, interchannel time or phase differences, and interchannel cross-correlation. Typically such parameters are estimated for multiple spectral bands for each channel being coded and are dynamically estimated over time.

A typical prior art spatial coding system is shown in FIGS. 1*a* (encoder) and 1*b* (decoder). Multiple input signals are converted to the frequency domain using an overlapped DFT (discrete frequency transform). The DFT spectrum is then subdivided into bands approximating the ear's critical bands. An estimate of the interchannel amplitude differences, interchannel time or phase differences, and interchannel correlation is computed for each of the bands. These estimates are utilized to downmix the original input signals into a monophonic composite signal. The composite signal along with the estimated spatial parameters are sent to a decoder where the composite signal is converted to the frequency domain using the same overlapped DFT and critical band spacing. The spatial parameters are then applied to their corresponding bands to create an approximation of the original multichannel signal.

In the decoder, application of the interchannel amplitude and time or phase differences is relatively straightforward, but modifying the upmixed channels so that their interchannel correlation matches that of the original multi-channel signal is more challenging. Typically, with the application of only amplitude and time or phase differences at the decoder, the resulting interchannel correlation of the upmixed channels is greater than that of the original signal, and the resulting audio sounds more "collapsed" spatially or less ambient than the original. This is often attributable to averaging values across frequency and/or time in order to limit the side information transmission cost. In order to restore a perception of the original interchannel correlation, some type of decorrelation must be performed on at least some of the upmixed channels. In the Breebaart et al AES Convention Paper 6072 and WO 03/090206 international application, cited below, a technique is proposed for imposing a desired interchannel correlation between two channels that have been upmixed from a single downmixed channel. The downmixed channel is first run through a decorrelation filter to produce a second decorrelated signal. The two upmixed channels are then each computed as linear combinations of the original downmixed signal and the decorrelated signal. The decorrelation filter is designed as a frequency dependent delay, in which the delay decreases as frequency increases. Such a filter has the desirable property of providing noticeable audible decorrelation while reducing temporal dispersion of transients. Also, adding the decorrelated signal with the original signal may not result in the comb filter effects associated with a fixed delay decorrelation filter.

The technique in the Breebaart et al paper and application is designed for only two upmix channels, but such a technique is desirable for an arbitrary number of upmix channels. Aspects of the present invention provide not only a solution for this more general multichannel decorrelation problem but also provide an efficient implementation in the frequency domain.

DISCLOSURE OF THE INVENTION

Figure 1A:
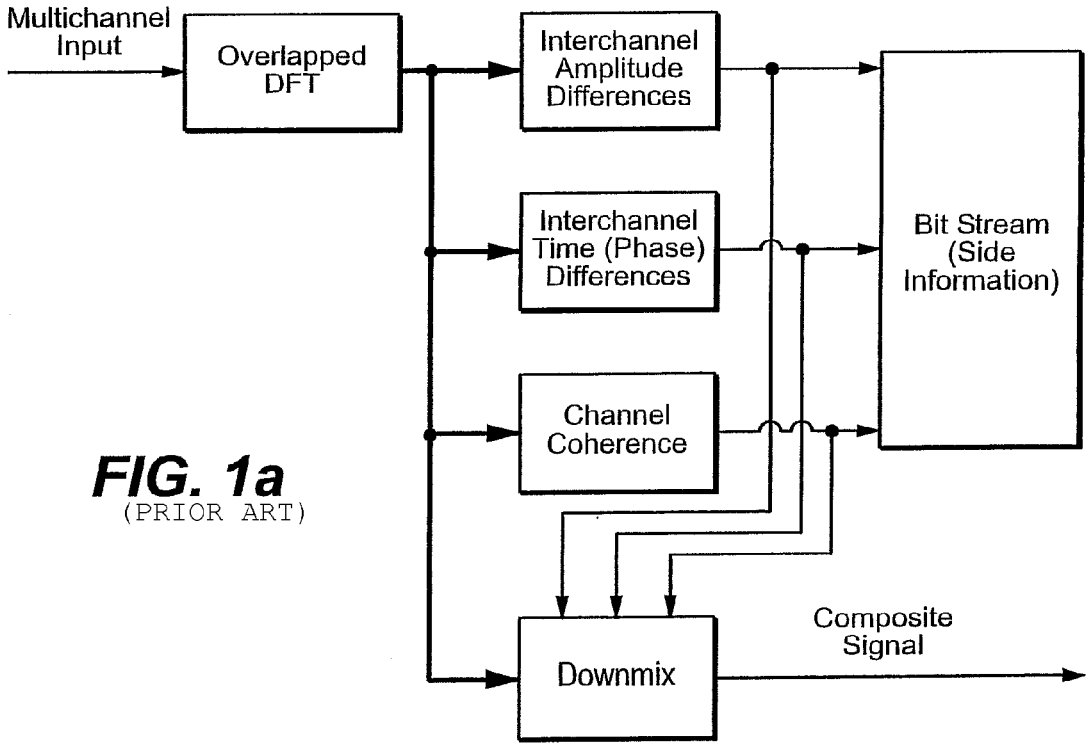
FIG. 1a (PRIOR ART)
FIGS. 1*a* and 1*b* are simplified block diagrams of a typical prior art spatial coding encoder and decoder, respectively.
Figure 1B:
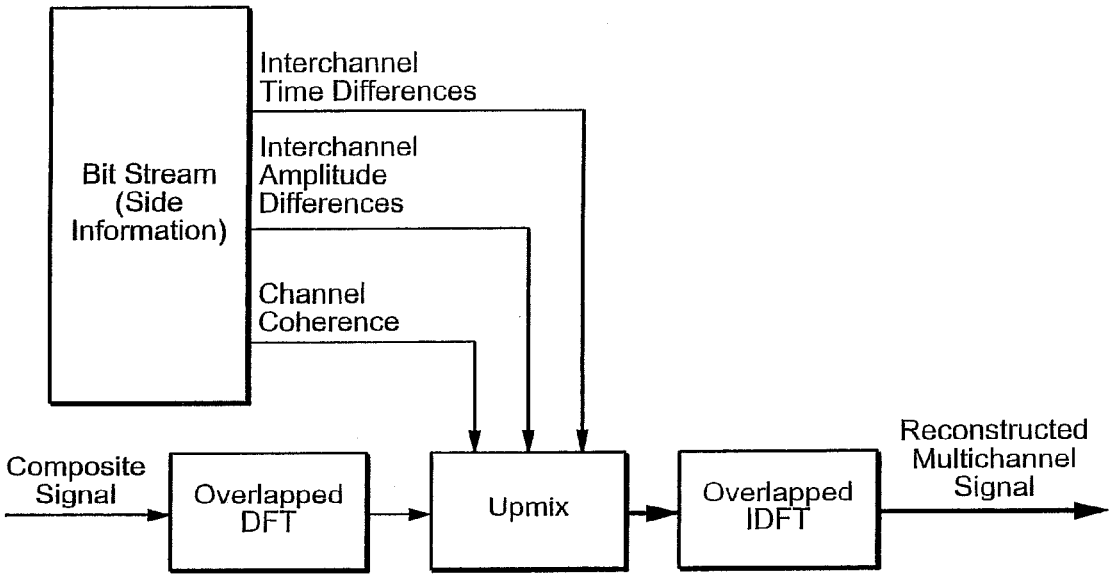
FIG. 1b (PRIOR ART)

An aspect of the present invention provides for processing a set of N audio signals by filtering each of the N signals with a unique decorrelating filter characteristic, the characteristic being a causal linear time-invariant characteristic in the time domain or the equivalent thereof in the frequency domain, and, for each decorrelating filter characteristic, combining, in a time and frequency varying manner, its input and output signals to provide a set of N processed signals. The combining may be a linear combining and may operate with the help of received parameters. Each unique decorrelating filter characteristic may be selected such that the output signal of each filter characteristic has less correlation with every one of the N audio signals than the corresponding input signal of each filter characteristic has with every one of the N signals and such that each output signal has less correlation with every other output signal than the corresponding input signal of each filter characteristic has with every other one of the N signals. Thus, each unique decorrelating filter is selected such that the output signal of each filter is approximately decorrelated with each of the N audio signals and such that each output signal is approximately decorrelated with every other output signal. The set of N audio signals may be synthesized from M audio signals, where M is one or more and N is greater than M, in which case there may be an upmixing of the M audio signals to N audio signals.

According to further aspects of the invention, parameters describing desired spatial relationships among said N synthesized audio signals may be received, in which case the upmixing may operate with the help of received parameters. The received parameters may describe desired spatial relationships among the N synthesized audio signals and the upmixing may operate with the help of received parameters.

According to other aspects of the invention, each decorrelating filter characteristic may be characterized by a model with multiple degrees of freedom. Each decorrelating filter characteristic may have a response in the form of a frequency varying delay where the delay decreases monotonically with increasing frequency. The impulse response of each filter characteristic may be specified by a sinusoidal sequence of finite duration whose instantaneous frequency decreases monotonically, such as from X to zero over the duration of the sequence. A noise sequence may be added to the instantaneous phase of the sinusoidal sequence, for example, to reduce audible artifacts under certain signal conditions.

According to yet other aspects of the present invention, parameters may be received that describe desired spatial relationships among the N processed signals, and the degree of combining may operate with the help of received parameters. Each of the audio signals may represent channels and the received parameters helping the combining operation may be parameters relating to interchannel cross-correlation. Other received parameters include parameters relating to one or more of interchannel amplitude differences and interchannel time or phase differences.

The invention applies, for example, to a spatial coding system in which N original audio signals are downmixed to M signals (M<N) in an encoder and then upmixed back to N signals in a decoder with the use of side information generated at the encoder. Aspects of the invention are applicable not only to spatial coding systems such as those described in the citations below in which the multichannel downmix is to (and the upmix is from) a single monophonic channel, but also to systems in which the downmix is to (and the upmix is from) multiple channels such as disclosed in International Application PCT/US2005/006359 of Mark Franklin Davis, filed Feb. 28, 2005, entitled "Low Bit Rate Audio Encoding and Decoding in Which Multiple Channels Are Represented By Fewer Channels and Auxiliary Information." Said PCT/US2005/006359 application is hereby incorporated by reference in its entirety.

At the decoder, a first set of N upmixed signals is generated from the M downmixed signals by applying the interchannel amplitude and time or phase differences sent in the side information. Next, a second set of N upmixed signals is generated by filtering each of the N signals from the first set with a unique decorrelation filter. The filters are "unique" in the sense that there are N different decorrelation filters, one for each signal. The set of N unique decorrelation filters is designed to generate N mutually decorrelated signals (see equation 3b below) that are also decorrelated with respect to the filter inputs (see equation 3a below). These well-decorrelated signals are used, along with the unfiltered upmix signals to generate output signals from the decoder that approximate, respectively, each of the input signals to the encoder. Each of the approximations is computed as a linear combination of each of the unfiltered signals from the first set of upmixed signals and the corresponding filtered signal from the second set of upmixed signals. The coefficients of this linear combination vary with time and frequency and are sent to the decoder in the side information generated by the encoder. To implement the system efficiently in some cases, the N decorrelation filters preferably may be applied in the frequency domain rather than the time domain. This may be implemented, for example, by properly zero-padding and windowing a DFT used in the encoder and decoder as is described below. The filters may also be applied in the time domain.

BEST MODE FOR CARRYING OUT THE INVENTION

Figure 2:
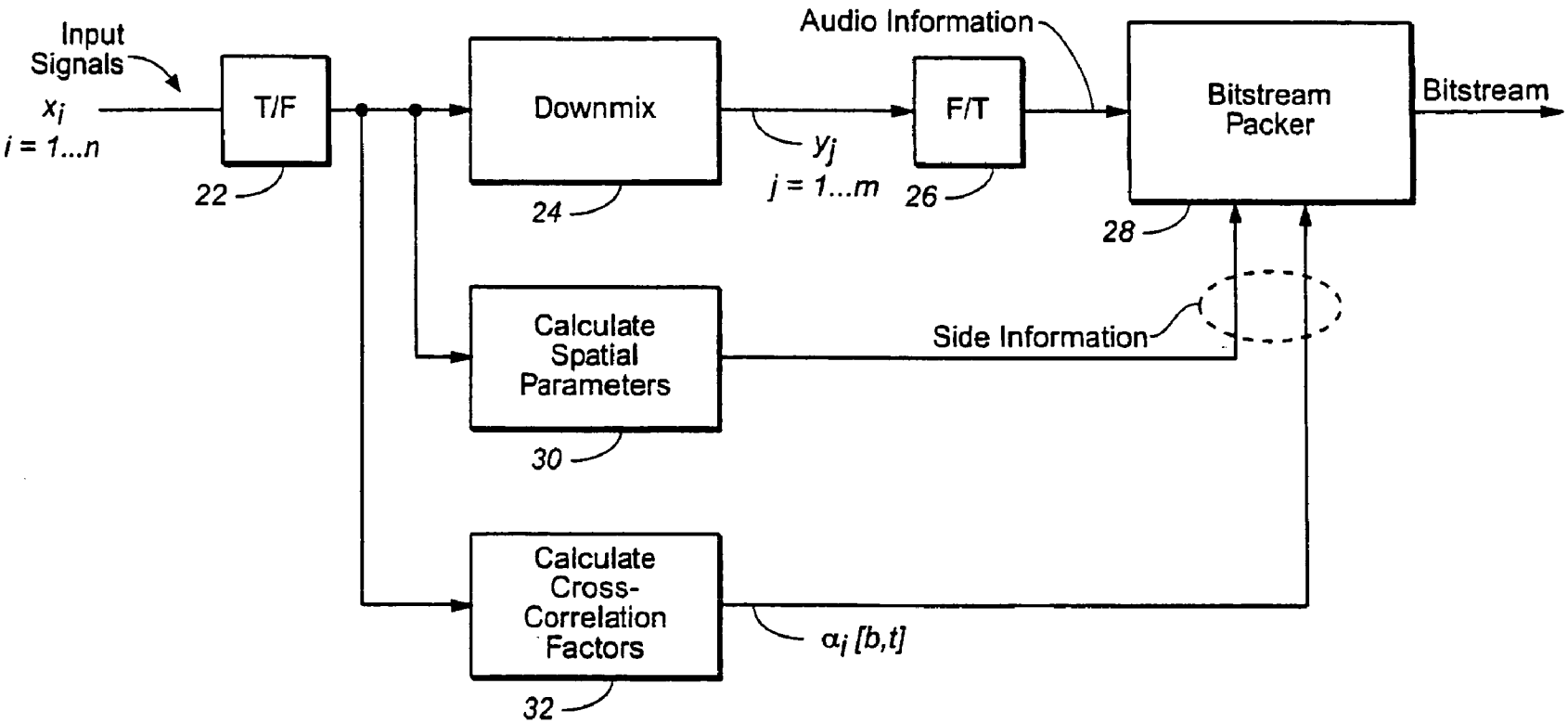
FIG. 2 is a simplified functional schematic block diagram of an example of an encoder or encoding function embodying aspects of the present invention.
Figure 3:
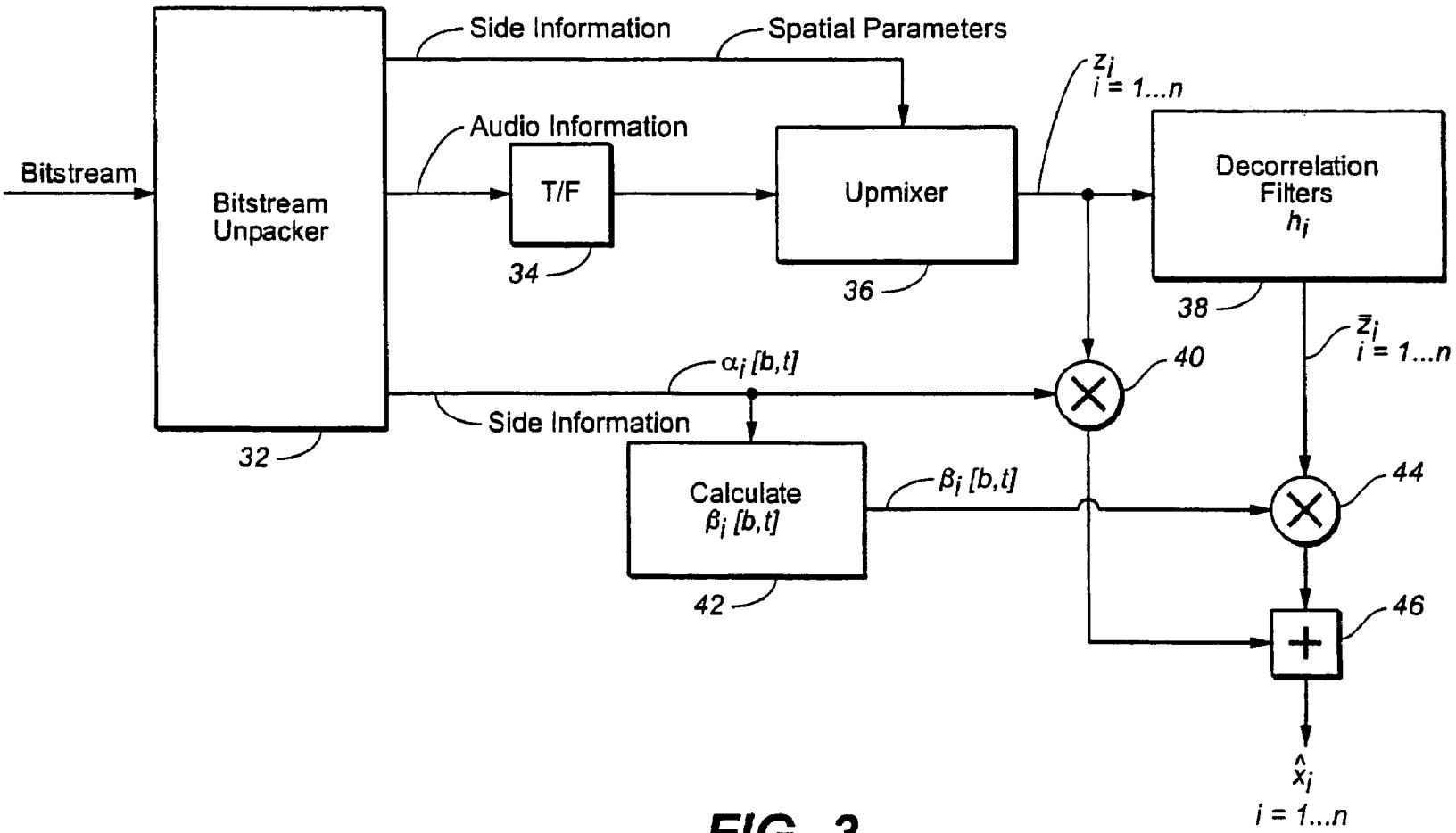
FIG. 3 is a simplified functional schematic block diagram of an example of a decoder or decoding function embodying aspects of the present invention.

Referring to FIGS. 2 and 3, the original N audio signals are represented by $x_i$, i=1 . . . N. The M downmixed signals generated at the encoder are represented by $y_j$, j=1 . . . M. The first set of upmixed signals generated at the decoder through application of the interchannel amplitude and time or phase differences is represented by $z_i$, i=1 . . . N. The second set of upmixed signals at the decoder is represented by $\bar{z}_i$, i=1 . . . N. This second set is computed through convolution of the first set with the decorrelation filters:

$$\bar{z}_i = h_i * z_i, \tag{1}$$

where $h_i$ is the impulse response of the decorrelation filter associated with signal i. Lastly, the approximation to the original signals is represented by $\hat{x}_i$, i=1 . . . N. These signals are computed by mixing signals from the described first and second set in a time and frequency varying manner:

$$\hat{X}_i[b,t] = \alpha_i[b,t]Z_i[b,t] + \beta_i[b,t]\bar{Z}_i[b,t], \tag{2}$$

where $Z_i[b,t]$, $\bar{Z}_i[b,t]$, and $\hat{X}_i[b,t]$ are the short-time frequency representations of signals $z_i$, $\bar{z}_i$, and $\hat{x}_i$, respectively, at critical band b and time block t. The parameters $\alpha_i[b,t]$ and $\beta_i[b,t]$ are the time and frequency varying mixing coefficients specified in the side information generated at the encoder. They may be computed as described below under the heading "Computation of Mixing Coefficients."

Design of the Decorrelation Filters

The set of decorrelation filters $h_i$, i=1 . . . N, are designed so that all the signals $z_i$ and $\bar{z}_i$ are approximately mutually decorrelated:

$$E\{z_i\bar{z}_j\} \cong 0 i=1 \ldots N, j=1 \ldots N, \tag{3a}$$

$$E\{\bar{z}_i\bar{z}_j\} \cong 0 i=1 \ldots N, j=1 \ldots N, i \neq j, \tag{3b}$$

where E represents the expectation operator. In other words, each unique decorrelating filter characteristic is selected such that the output signal $\bar{z}_i$ of each filter characteristic has less correlation with every one of the input audio signals $z_i$ than the corresponding input signal of each filter characteristic has with every one of the input signals and such that each output signal $\bar{z}_i$ has less correlation with every other output signal than the corresponding input signal $z_i$ of each filter characteristic has with every other one of the input signals. As is well known in the art, a simple delay may be used as a decorrelation filter, where the decorrelating effect becomes greater as the delay is increased. However, when a signal is filtered with such a decorrelator and then added with the original signal, as is specified in equation 2, echoes, especially in the higher frequencies, may be heard. An improvement also known in the art is a frequency varying delay filter in which the delay decreases linearly with frequency from some maximum delay to zero. The only free parameter in such a filter is this maximum delay. With such a filter the high frequencies are not delayed significantly, thus eliminating perceived echoes, while the lower frequencies still receive significant delay, thus maintaining the decorrelating effect. As an aspect of the present invention, a decorrelation filter characteristic is preferred that is characterized by a model that has more degrees of freedom. In particular, such a filter may have a monotonically decreasing instantaneous frequency function, which, in theory, may take on an infinite variety of forms. The impulse response of each filter may be specified by a sinusoidal sequence of finite duration whose instantaneous frequency decreases monotonically, for example, from $\pi$ to zero over the duration of the sequence. This means that the delay for the Nyquist frequency is equal to 0 and the delay for DC is equal to the length of the sequence. In its general form, the impulse response of each filter may be given by $$h_i[n]==A_i\sqrt{|\omega'_i(n)|}\cos(\phi_i(n)),\ n=0\ldots L_i-1 \tag{4a}$$

$$\phi_i(t)=\int\omega_i(t)dt+\phi_0, \tag{4b}$$

where $\omega_i(t)$ is the monotonically decreasing instantaneous frequency function, $\omega'_i(t)$ is the first derivative of the instantaneous frequency, $\phi_i(t)$ is the instantaneous phase given by the integral of the instantaneous frequency plus some initial phase $\phi_0$, and $L_i$ is the length of the filter. The multiplicative term $\sqrt{\omega'_i(t)}$ is required to make the frequency response of $h_i[n]$ approximately flat across all frequency, and the filter amplitude A, is chosen so that the magnitude frequency response is approximately unity. This is equivalent to choosing $A_i$ so that the following holds:

$$\sum_{n=0}^{L_i-1} h_i^2[n] = 1. \tag{4c}$$

One useful parameterization of the function $\omega_i(t)$ is given by $$\omega_i(t) = \pi\left(1-\frac{t}{L_i}\right)^{\alpha_i}, \tag{5}$$

where the parameter $\alpha_i$ controls how rapidly the instantaneous frequency decreases to zero over the duration of the sequence. One may manipulate equation 5 to solve for the delay t as a function of radian frequency $\omega$:

$$t_i(\omega) = L_i\left(1-\left(\frac{\omega}{\pi}\right)^{\frac{1}{\alpha_i}}\right) \tag{6}$$

One notes that when $\alpha_i=0$, $t_i(\omega)=L_i$ for all $\omega$: in other words, the filter becomes a pure delay of length $L_i$. When $\alpha_i=\infty$, $t_i(\omega)=0$ for all $\omega$: the filter is simply an impulse. For auditory decorrelation purposes, setting $\alpha_i$ somewhere between 1 and 10 has been found to produce the best sounding results. However, because the filter impulse response $h_i[n]$ in equation 4a has the form of a chirp-like sequence, filtering impulsive audio signals with such a filter can sometimes result in audible "chirping" artifacts in the filtered signal at the locations of the original transients. The audibility of this effect decreases as $\alpha_i$ increases, but the effect may be further reduced by adding a noise sequence to the instantaneous phase of the filter's sinusoidal sequence. This may be accomplished by adding a noise term to instantaneous phase of the filter response:

$$h_i[n]=A_i\sqrt{|\omega'_i(n)|}\cos(\phi_i(n)+N_i[n]),\ n=0\ldots L_i-1 \tag{7}$$

Making this noise sequence $N_i[n]$ equal to white Gaussian noise with a variance that is a small fraction of $\pi$ is enough to make the impulse response sound more noise-like than chirp-like, while the desired relation between frequency and delay specified by $\omega_i(t)$ is still largely maintained. The filter in equation 7 with $\omega_i(t)$ as specified in equation 5 has four free parameters: $L_i$, $\alpha_i$, $\phi_0$, and $N_i[n]$. By choosing these parameters sufficiently different from one another across all the filters $h_i[n]$, i=1 . . . N, the desired decorrelation conditions in equation 3 can be met.

Computation of the Mixing Coefficients

The time and frequency varying mixing coefficients $\alpha_i[b,t]$ and $\beta_i[b,t]$ may be generated at the encoder from the per-band correlations between pairs of the original signals $x_i$. Specifically, the normalized correlation between signal i and j (where "i" is any one of the signals 1 . . . N and "j" is any other one of the signals 1 . . . N) at band b and time t is given by $$C_{ij}[b,t] = \frac{|E_\tau\{X_i[b,\tau]X_j^*[b,\tau]\}|}{\sqrt{E_\tau\{|X_i[b,\tau]|^2\}E_\tau\{|X_i[b,\tau]|^2\}}}, \tag{8}$$

where the expectation E is carried out over time $\tau$ in a neighborhood around time t. Given the conditions in (3) and the additional constraint that $\alpha_i^2[b,t]+\beta_i^2[b,t]=1$, it can be shown that the normalized correlations between the pairs of decoder output signals $\hat{x}_i$ and $\hat{x}_j$, each approximating an input signal, are given by $$\hat{C}_{ij}[b,t]\cong\alpha_i[b,t]\alpha_j[b,t]. \tag{9}$$

An aspect of the present invention is the recognition that the N values $\alpha_i[b,t]$ are insufficient to reproduce the values $C_{ij}[b,t]$ for all i and j, but they may be chosen so that $\hat{C}_{ij}[b,t]\cong C_{ij}[b,t]$ for one particular signal i with respect to all other signals j. A further aspect of the present invention is the recognition that one may choose that signal i as the most dominant signal in band b at time t. The dominant signal is defined as the signal for which $E_\tau\{|X_i[b,\tau]|^2\}$ is greatest across i=1 . . . N. Denoting the index of this dominant signal as d, the parameters $\alpha_i[b,t]$ are then given by $$\alpha_i[b,t]=1,\ i=d, \tag{9}$$

$$\alpha_i[b,t]=C_{di}[b,t],\ i\neq d.$$

These parameters $\alpha_i[b,t]$ are sent in the side information of the spatial coding system. At the decoder, the parameters $\beta_i[b,t]$ may then be computed as $$\beta_i[b,t]=\sqrt{1-\alpha_i^2[b,t]}. \tag{10}$$

In order to reduce the transmission cost of the side information, one may send the parameter $\alpha_i[b,t]$ for only the dominant channel and the second-most dominant channel. The value of $\alpha_i[b,t]$ for all other channels is then set to that of the second-most dominant channel. As a further approximation, the parameter $\alpha_i[b,t]$ may be set to the same value for all channels. In this case, the square root of the normalized correlation between the dominant channel and the second-most dominant channel may be used.

Implementation of the Decorrelation Filters in the Frequency Domain

Figure 4:
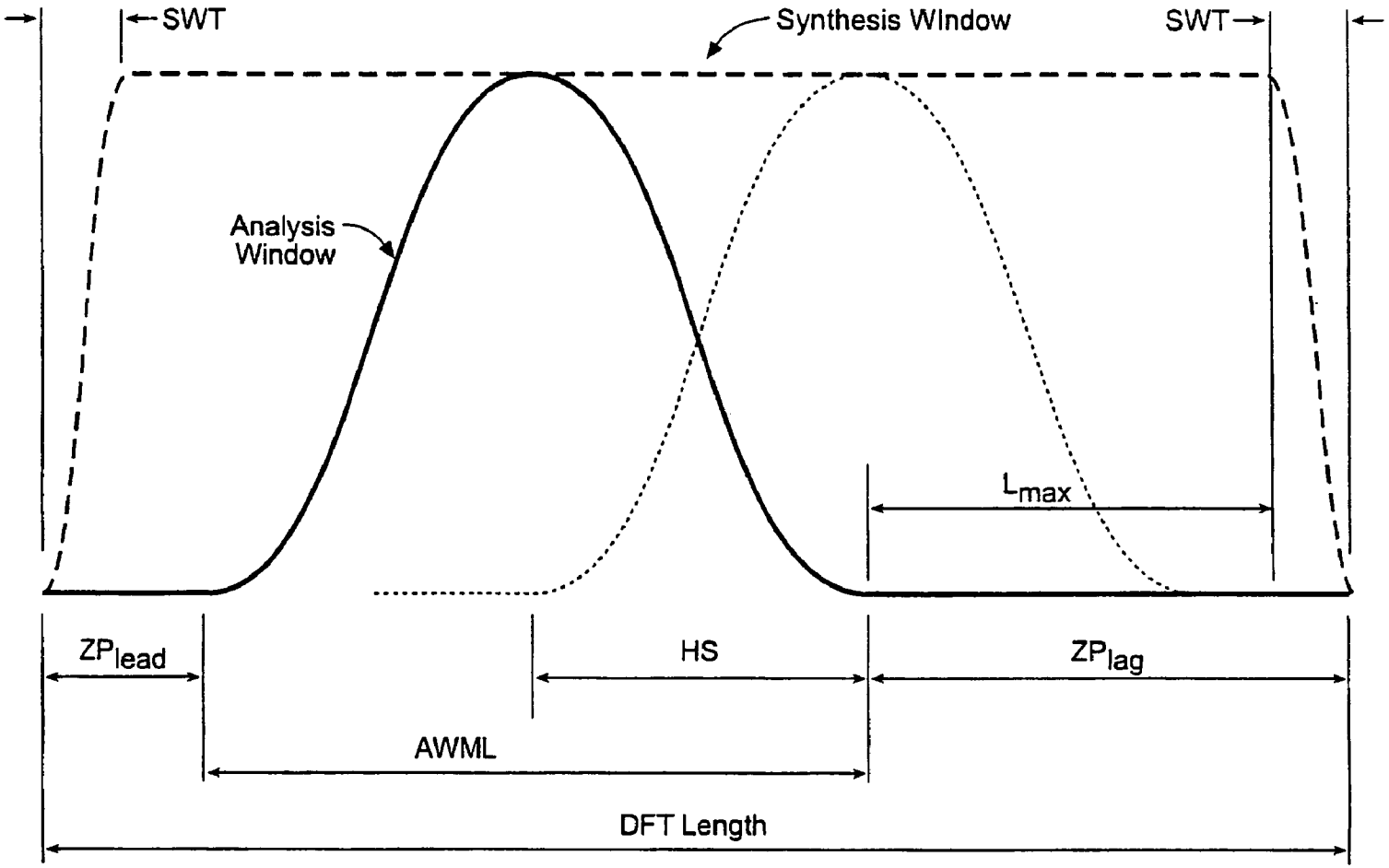
FIG. 4 is an idealized depiction of an analysis/synthesis window pair suitable for implementing aspects of the present invention.

An overlapped DFT with the proper choice of analysis and synthesis windows may be used to efficiently implement aspects of the present invention. FIG. 4 depicts an example of a suitable analysis/synthesis window pair. FIG. 4 shows overlapping DFT analysis and synthesis windows for applying decorrelation in the frequency domain. Overlapping tapered windows are needed to minimize artifacts in the reconstructed signals.

The analysis window is designed so that the sum of the overlapped analysis windows is equal to unity for the chosen overlap spacing. One may choose the square of a Kaiser-Bessel-Derived (KBD) window, for example. With such an analysis window, one may synthesize an analyzed signal perfectly with no synthesis window if no modifications have been made to the overlapping DFTs. In order to perform the convolution with the decorrelation filters through multiplication in the frequency domain, the analysis window must also be zero-padded. Without zero-padding, circular convolution rather than normal convolution occurs. If the largest decorrelation filter length is given by $L_{max}$, then a zero-padding after the analysis window of at least $L_{max}$ is required. However, the interchannel amplitude and time and phase differences are also applied in the frequency domain, and these modifications result in convolutional leakage both before and after the analysis window. Therefore, additional zero-padding is added both before and after the main lobe of the analysis window. Finally, a synthesis window is utilized which is unity across the main lobe of the analysis window and the $L_{max}$ length zero-padding. Outside of this region, however, the synthesis window tapers down to zero in order to eliminate glitches in the synthesized audio. Aspects of the present invention include such analysis/synthesis window configurations and the use of zero-padding.

A set of suitable window parameters are listed below:

| | |
|---|---|
| DFT Length: | 2048 |
| Analysis Window Main-Lobe Length (AWML): | 1024 |
| Hop Size (HS): | 512 |
| Leading Zero-Pad ($ZP_{lead}$): | 256 |
| Lagging Zero-Pad ($ZP_{lag}$): | 768 |
| Synthesis Window Taper (SWT): | 128 |
| $L_{max}$: | 640 |

Although such window parameters have been found to be suitable, the particular values are not critical to the invention.

Letting $Z_i[k,t]$ be the overlapped DFT of signal $z_i$ at bin k and time block t and $H_i[k]$ be the DFT of decorrelation filter $h_i$, the overlapped DFT of signal $\bar{z}_i$ may be computed as $$\bar{Z}_i[k,t]=H_i[k]Z_i[k,t], \tag{11}$$

where $Z_i[k,t]$ has been computed from the overlapped DFTs of the downmixed signals $y_j$, j=1 . . . M, utilizing the discussed analysis window. Letting $k_{bBegin}$ and $k_{bEnd}$ be the beginning and ending bin indices associated with band b, equation (2) may be implemented as $$\hat{X}_i[k,t]=\alpha_i[b,t]Z_i[k,t]+\beta[b,t]H_i[k]Z_i[k,t], \quad k_{bBegin}\leq k\leq k_{bEnd} \tag{12}$$

The signals $\hat{x}_i$ are then synthesized from $\hat{X}_i[k,t]$ by performing the inverse DFT on each block and overlapping and adding the resulting time-domain segments using the synthesis window described above.

Referring to FIG. 2, in which a simplified example of encoder embodying aspects of the present invention is shown, the input signals $x_i$, a plurality of audio input signals such as PCM signals, time samples of respective analog audio signals, 1 through n, are applied to respective time-domain to frequency-domain converters or conversion functions ("T/F") 22. For simplicity in presentation, only one T/F block is shown, it being understood that there is one for each of the 1 through N input signals. The input audio signals may represent, for example, spatial directions such as left, center, right, etc. Each T/F may be implemented, for example, by dividing the input audio samples into blocks, windowing the blocks, overlapping the blocks, transforming each of the windowed and overlapped blocks to the frequency domain by computing a discrete frequency transform (DFT) and partitioning the resulting frequency spectrums into bands simulating the ear's critical bands, for example, twenty-one bands using, for example, the equivalent-rectangular band (ERB) scale. Such DFT processes are well known in the art. Other time-domain to frequency domain conversion parameters and techniques may be employed. Neither the particular parameters nor the particular technique are critical to the invention. However, for the purposes of ease in explanation. the descriptions herein assume that such a DFT conversion technique is employed.

The frequency-domain outputs of T/F 22 are each a set of spectral coefficients. All of these sets may be applied to a downmixer or downmixing function ("downmix") 24. The downmixer or downmixing function may be as described in various ones of the cited spatial coding publications or as described in the above-cited International Patent Application of Davis et al. The output of downmix 24, a single channel $y_j$ in the case of the cited spatial coding systems, or multiple channels $y_j$ as in the cited Davis et al document, may be perceptually encoded using any suitable coding such as AAC, AC-3, etc. Publications setting forth details of suitable perceptual coding systems are included under the heading below "Incorporation by Reference." The output(s) of the downmix 24, whether or not perceptually coded, may be characterized as "audio information." The audio information may be converted back to the time domain by a frequency-domain to time-domain converter or conversion function ("F/T") 26 that each performs generally the inverse functions of an above-described T/F, namely an inverse FFT, followed by windowing and overlap-add. The time-domain information from F/T 26 is applied to a bitstream packer or packing function ("bitstream packer") 28 that provides an encoded bitstream output.

The sets of spectral coefficients produced by T/F 22 are also applied to a spatial parameter calculator or calculating function 30 that calculates "side information" may comprise, "spatial parameters" such as, for example, interchannel amplitude differences, interchannel time or phase differences, and interchannel cross-correlation as described in various ones of the cited spatial coding publications. The spatial parameter side information is applied to the bitstream packer 28 that may include the spatial parameters in the bitstream.

The sets of spectral coefficients produced by T/F 22 are also applied to a cross-correlation factor calculator or calculating function ("calculate cross-correlation factors") 32 that calculates the cross-correlation factors $\alpha_i[b,t]$, as described above. The cross-correlation factors are applied to the bitstream packer 28 that may include the cross-correlation factors in the bitstream. The cross-correlation factors may also be characterized as "side information." Side information is information useful in the decoding of the audio information.

In practical embodiments, not only the audio information, but also the side information and the cross-correlation factors will likely be quantized or coded in some way to minimize their transmission cost. However, no quantizing and de-quantizing is shown in the figures for the purposes of simplicity in presentation and because such details are well known and do not aid in an understanding of the invention.

Referring to FIG. 3, in which a simplified example of a decoder embodying aspects of the present invention is shown, a bitstream, as produced, for example by an encoder of the type described in connection with FIG. 2, is applied to a bitstream unpacker 32 that provides the spatial information side information, the cross-correlation side information ($\alpha_i$[b,t]), and the audio information. The audio information is applied to a time-domain to frequency-domain converter or conversion function ("T/F") 34 that may be the same as one of the convertors 22 of FIG. 2. The frequency-domain audio information is applied to an upmixer 36 that operates with the help of the spatial parameters side information that it also receives. The upmixer may operate as described in various ones of the cited spatial coding publications, or, in the case of the audio information being conveyed in multiple channels, as described in said International Application of Davis et al. The upmixer outputs are a plurality of signals $z_i$ as referred to above. Each of the upmixed signals $z_i$ are applied to a unique decorrelation filter 38 having a characteristic $h_i$ as described above. For simplicity in presentation only a single filter is shown, it being understood that there is a separate and unique filter for each upmixed signal. The outputs of the decorrelation filters are a plurality of signals $\bar{z}_i$, as described above. The cross-correlation factors $\alpha_i[b,t]$ are applied to a multiplier 40 where they are multiplied times respective ones of the upmixed signals $z_i$, as described above. The cross-correlation factors $\alpha_i[b,t]$ are also applied to a calculator or calculation function ("calculate $\beta_i[b,t]$") 42 that derives the cross-correlation factor $\beta_i[b,t]$ from the cross-correlation factor $\alpha_i[b,t]$, as described above. The cross-correlation factors $\beta_i[b,t]$ is applied to multiplier 44 where they are multiplied times respective ones of the decorrelation filtered upmix signals $\bar{z}_i$, as described above. The outputs of multipliers 40 and 44 are summed in an additive combiner or combining function ("+") 46 to produce a plurality of output signals $\hat{x}_i$, each of which approximates a corresponding input signal $x_i$.

Implementation

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. For example, some of the steps described herein may be order independent, and thus can be performed in an order different from that described.

INCORPORATION BY REFERENCE

The following patents, patent applications and publications are hereby incorporated by reference, each in their entirety.

AC-3

*ATSC Standard A52/A: Digital Audio Compression Standard* (*AC*-3), *Revision A*, Advanced Television Systems Committee, 20 Aug. 2001. The A/52A document is available on the World Wide Web at http://www.atsc.org/standards.html.

"Design and Implementation of AC-3 Coders," by Steve Vernon, *IEEE Trans. Consumer Electronics*, Vol. 41, No. 3, August 1995.

"The AC-3 Multichannel Coder" by Mark Davis, Audio Engineering Society Preprint 3774, 95th AES Convention, October, 1993.

"High Quality, Low-Rate Audio Transform Coding for Transmission and Multimedia Applications," by Bosi et al, Audio Engineering Society Preprint 3365, 93rd AES Convention, October, 1992.

U.S. Pat. Nos. 5,583,962; 5,632,005; 5,633,981; 5,727,119; and 6,021,386.

AAC

ISO/IEC JTC1/SC29, "Information technology—very low bitrate audio-visual coding," ISO/IEC IS-14496 (Part 3, Audio), 1996

1) ISO/IEC 13818-7. "MPEG-2 advanced audio coding, AAC". International Standard, 1997;

M. Bosi, K. Brandenburg, S. Quackenbush, L. Fielder, K. Akagiri, H. Fuchs, M. Dietz, J. Herre, G. Davidson, and Y. Oikawa: "ISO/IEC MPEG-2 Advanced Audio Coding". *Proc. of the* 101*st AES-Convention,* 1996;

M. Bosi, K. Brandenburg, S. Quackenbush, L. Fielder, K. Akagiri, H. Fuchs, M. Dietz, J. Herre, G. Davidson, Y. Oikawa: "ISO/IEC MPEG-2 Advanced Audio Coding", *Journal of the AES*, Vol. 45, No. 10, October 1997, pp. 789-814;

Karlheinz Brandenburg: "MP3 and AAC explained". *Proc. of the AES* 17*th International Conference on High Quality Audio Coding*, Florence, Italy, 1999; and G. A. Soulodre et al.: "Subjective Evaluation of State-of-the-Art Two-Channel Audio Codecs" *J. Audio Eng. Soc.*, Vol. 46, No. 3, pp 164-177, March 1998.

MPEG Intensity Stereo

U.S. Pat. Nos. 5,323,396; 5,539,829; 5,606,618 and 5,621,855.

United States Published Patent Application US 2001/0044713, published.

Spatial and Parametric Coding

International Application PCT/US2005/006359 of Mark Franklin Davis, filed Feb. 28, 2005, entitled "Low Bit Rate Audio Encoding and Decoding in Which Multiple Channels Are Represented By Fewer Channels and Auxiliary Information.

United States Published Patent Application US 2003/0026441, published Feb. 6, 2003

United States Published Patent Application US 2003/0035553, published Feb. 20, 2003, United States Published Patent Application US 2003/0219130 (Baumgarte & Faller) published Nov. 27, 2003, Audio Engineering Society Paper 5852, March 2003

Published International Patent Application WO 03/090207, published Oct. 30, 2003

Published International Patent Application WO 03/090208, published Oct. 30, 2003

Published International Patent Application WO 03/007656, published Jan. 22, 2003

Published International Patent Application WO 03/090206, published Oct. 30, 2003.

United States Published Patent Application Publication US 2003/0236583 A1, Baumgarte et al, published Dec. 25, 2003, "Hybrid Multi-Channel/Cue Coding/Decoding of Audio Signals," application Ser. No. 10/246,570.

"Binaural Cue Coding Applied to Stereo and Multi-Channel Audio Compression," by Faller et al, Audio Engineering Society Convention Paper 5574, 112$^{th}$ Convention, Munich, May 2002.

"Why Binaural Cue Coding is Better than Intensity Stereo Coding," by Baumgarte et al, Audio Engineering Society Convention Paper 5575, 112$^{th}$ Convention, Munich, May 2002.

"Design and Evaluation of Binaural Cue Coding Schemes," by Baumgarte et al, Audio Engineering Society Convention Paper 5706, 113$^{th}$ Convention, Los Angeles, October 2002.

"Efficient Representation of Spatial Audio Using Perceptual Parameterization," by Faller et al, IEEE Workshop on Applications of Signal Processing to Audio and Acoustics 2001, New Paltz, N.Y., October 2001, pp. 199-202.

"Estimation of Auditory Spatial Cues for Binaural Cue Coding," by Baumgarte et al, Proc. ICASSP 2002, Orlando, Fla., May 2002, pp. II-1801-1804.

"Binaural Cue Coding: A Novel and Efficient Representation of Spatial Audio," by Faller et al, Proc. ICASSP 2002, Orlando, Fla., May 2002, pp. II-1841-II-1844.

"High-quality parametric spatial audio coding at low bitrates," by Breebaart et al, Audio Engineering Society Convention Paper 6072, 116$^{th}$ Convention, Berlin, May 2004.

"Audio Coder Enhancement using Scalable Binaural Cue Coding with Equalized Mixing," by Baumgarte et al, Audio Engineering Society Convention Paper 6060, 116$^{th}$ Convention, Berlin, May 2004.

"Low complexity parametric stereo coding," by Schuijers et al, Audio Engineering Society Convention Paper 6073, 116$^{th}$ Convention, Berlin, May 2004.

"Synthetic Ambience in Parametric Stereo Coding," by Engdegard et al, Audio Engineering Society Convention Paper 6074, 116$^{th}$ Convention, Berlin, May 2004.

Other

U.S. Pat. No. 5,812,971, Herre, "Enhanced Joint Stereo Coding Method Using Temporal Envelope Shaping," Sep. 22, 1998

"Intensity Stereo Coding," by Herre et al, Audio Engineering Society Preprint 3799, 96$^{th}$ Convention, Amsterdam, 1994.

United States Published Patent Application Publication US 2003/0187663 A1, Truman et al, published Oct. 2, 2003, "Broadband Frequency Translation for High Frequency Regeneration," application Ser. No. 10/113,858.

We claim:

1. A method for processing a set of N audio signals, comprising filtering each of the N audio signals with a unique decorrelating filter characteristic, the characteristic being a causal linear time-invariant characteristic in the time domain or the equivalent thereof in the frequency domain, and, for each decorrelating filter characteristic, combining, in a time and frequency varying manner, its input and output signals to provide a set of N processed signals, wherein said set of N audio signals are synthesized from M audio signals, where M is one or more and N is greater than M, further comprising upmixing the M audio signals to N audio signals prior to filtering each of the N audio signals with a unique decorrelating filter characteristic.

2. A method according to claim 1 wherein each unique decorrelating filter characteristic is selected such that the output signal of each filter characteristic has less correlation with every one of the N audio signals than the corresponding input signal of each filter characteristic has with every one of the N audio signals and such that each output signal has less correlation with every other output signal than the corresponding input signal of each filter characteristic has with every other one of the N audio signals.

3. A method according to claim 1 further comprising receiving parameters describing desired spatial relationships among said N synthesized audio signals, and wherein said upmixing operates with the help of received parameters.

4. A method according to claim 2 further comprising receiving parameters describing desired spatial relationships among said N synthesized audio signals, and wherein said upmixing operates with the help of received parameters.

5. A method according to any one of claims 1, 2, 3 or 4 wherein each decorrelating filter characteristic is characterized by a model with multiple degrees of freedom.

6. A method according to claim 5 wherein each decorrelating filter characteristic has a response in the form of a frequency varying delay where the delay decreases monotonically with increasing frequency.

7. A method according to any ones of claims 1, 2, 3 or 4 wherein each decorrelating filter characteristic has a response in the form of a frequency varying delay where the delay decreases monotonically with increasing frequency.

8. A method according to claim 2 wherein the impulse response of each filter characteristic is specified by a sinusoidal sequence of finite duration whose instantaneous frequency decreases monotonically.

9. A method according to claim 8 wherein a noise sequence is added to the instantaneous phase of the sinusoidal sequence.

10. A method according to claim 1, wherein said combining is a linear combining.

11. A method according to claim 1, wherein the degree of combining by said combining operates with the help of received parameters.

12. A method according to claim 1, further comprising receiving parameters describing desired spatial relationships among said N processed signals, and wherein the degree of combining by said combining operates with the help of received parameters.

13. A method according to claim 11 or claim 12 wherein each of the N audio signals represent channels and the received parameters helping the combining operation are parameters relating to interchannel cross-correlation.

14. A method according to claim 13 wherein other received parameters include parameters relating to one or more of interchannel amplitude differences and interchannel time or phase differences.

15. Apparatus adapted to perform the methods of any one of claims 1, 2, 3 or 4.

16. A computer program, stored on a non-transitory computer-readable medium, for causing a computer to perform the methods of any one of claims 1, 2, 3 or 4.

17. Apparatus for processing a set of N audio signals, comprising means for filtering each of the N audio signals with a unique decorrelating filter characteristic, the characteristic being a causal linear time-invariant characteristic in the time domain or the equivalent thereof in the frequency domain, for each decorrelating filter characteristic, means for combining, in a time and frequency varying manner, its input and output signals to provide a set of N processed signals, and wherein said set of N audio signals are synthesized from M audio signals, where M is one or more and N is greater than M, further comprising an upmixer that upmixes the M audio signals to N audio signals prior to filtering each of the N audio signals with a unique decorrelating filter characteristic.

* * * * *